US006012237A

United States Patent [19]

Okajima et al.

[11] Patent Number: 6,012,237

[45] Date of Patent: Jan. 11, 2000

[54] MULTIPLE JOINTED BACK SUPPORT SYSTEM FOR A SNOWBOARD BOOT

[75] Inventors: Shinpei Okajima, Izumi; Kazuki Tanaka, Sakai, both of Japan

[73] Assignee: Shimano, Inc., Osaka, Japan

[21] Appl. No.: 09/126,698

[22] Filed: Jul. 30, 1998

[30] Foreign Application Priority Data

Nov. 18, 1997 [JP] Japan ..... 9-333561
Dec. 22, 1997 [JP] Japan ..... 9-365728

[51] Int. Cl.[7] ..... A43B 5/00

[52] U.S. Cl. ..... 36/118.2; 36/118.9; 36/117.1

[58] Field of Search ..... 36/115, 117.1, 36/118.2, 118.7, 118.8, 118.9

[56] References Cited

U.S. PATENT DOCUMENTS 5,345,080 9/1994 Meiselman ..... 36/115
5,775,009 7/1998 Marega et al. ..... 36/118.2
5,802,741 9/1998 Turner et al. ..... 36/115
5,848,796 12/1998 Meibock et al. ..... 36/115

FOREIGN PATENT DOCUMENTS 0 646 334 B1 4/1995 European Pat. Off. .
0 772 982 A2 5/1997 European Pat. Off. .
2719197 11/1995 France .
MI92A1237 11/1993 Italy .

*Primary Examiner*—M. D. Patterson
*Attorney, Agent, or Firm*—James A. Deland

[57] ABSTRACT

A back support structure for a snowboard boot includes a back support member for supporting a back surface of an ankle and a linking mechanism coupled to the back support member for coupling the back support member to a leg member of the snowboard boot. The linking mechanism includes a first pivot coupling and a second pivot coupling so that the back support member may pivot relative to the leg member around multiple axes to accommodate complex sideways inclinations of the leg.

39 Claims, 12 Drawing Sheets

MULTIPLE JOINTED BACK SUPPORT SYSTEM FOR A SNOWBOARD BOOT

BACKGROUND OF THE INVENTION

The present invention is directed to snowboard boots and, more particularly, to a snowboard boot capable of movement in two axial directions.

A snowboard is a variety of ski that glides on snow. Whereas a skier is mounted on the skis so as to face the front of the skis in the longitudinal direction of the skis, a snowboarder usually is mounted on the snowboard facing the side of the snowboard, usually facing at a small angle to the exact side of the snowboard. To impart a propulsive force to the snowboard, the snowboarder usually bends his or her knees while leaning toward the front of the snowboard. Thus, the ankle is inclined both forward with respect to the snowboarder (to the side of the snowboard) as well as to the side with respect to the snowboarder (to the front of the snowboard).

To operate the snowboard effectively, the boot worn by the snowboarder should accommodate the required inclination angles of the ankle. Some attempts to accommodate the inclination angles of the ankle are disclosed in DE 3,622,746; FR 2,719,197; EP 646,334; EP 772,982; and IT 1,255,752. In these references, an upper portion of the boot is pivotably connected to a lower portion of the boot so as to pivot around a longitudinal axis located above the heel of the boot. While such structures help to accommodate sideways inclination of the ankle, it is known that the human foot does not readily incline sideways unless the ankle also inclines forward at the same time. Thus, prior art boots that accommodate sideways inclination without also accommodating forward inclination do not work very effectively. Furthermore, sideways inclination of the ankle is not always accommodated effectively by a boot that pivots solely around one axis.

SUMMARY OF THE INVENTION

The present invention is directed to a snowboard boot that accommodates complex forward and sideways inclinations of the leg so that the snowboarder does not become fatigued and the snowboard may be controlled more effectively. In one embodiment of the present invention, a back support structure for a snowboard boot includes a back support member for supporting a back surface of an ankle and a linking mechanism coupled to the back support member for coupling the back support member to a leg member of the snowboard boot. The linking mechanism includes a first pivot coupling and a second pivot coupling so that the back support member may pivot relative to the leg member around multiple axes to accommodate complex sideways inclinations of the leg. In a more specific embodiment, the linking mechanism includes a first link having a first section pivotably coupled to the back support at the first pivot coupling and a second section that may be pivotally coupled to the leg member. Alternatively, a second link may have a first section pivotably coupled to the second section of the first link at the second pivot coupling, and the second section of the second link may be pivotably coupled to the leg member at a third pivot coupling. In all cases, the back support member may be pivotably coupled to a heel cup so that the back support member may pivot in forward and backward directions. The boot also may have a stopping mechanism to prevent excessive rearward pivoting of the leg member.

In an even more specific embodiment, the second link may be fixed to the leg member, and a third link may have a first section pivotably coupled to the second section of the second link at the third pivot coupling and a second section pivotably coupled to the back support at a fourth pivot coupling. Such a structure forms a four-bar linkage mechanism so that the leg section moves horizontally without pivoting around the back support member for applications that require such movement.

DETAILED DESCRIPTION OF THE EMBODIMENTS

Figure 1:
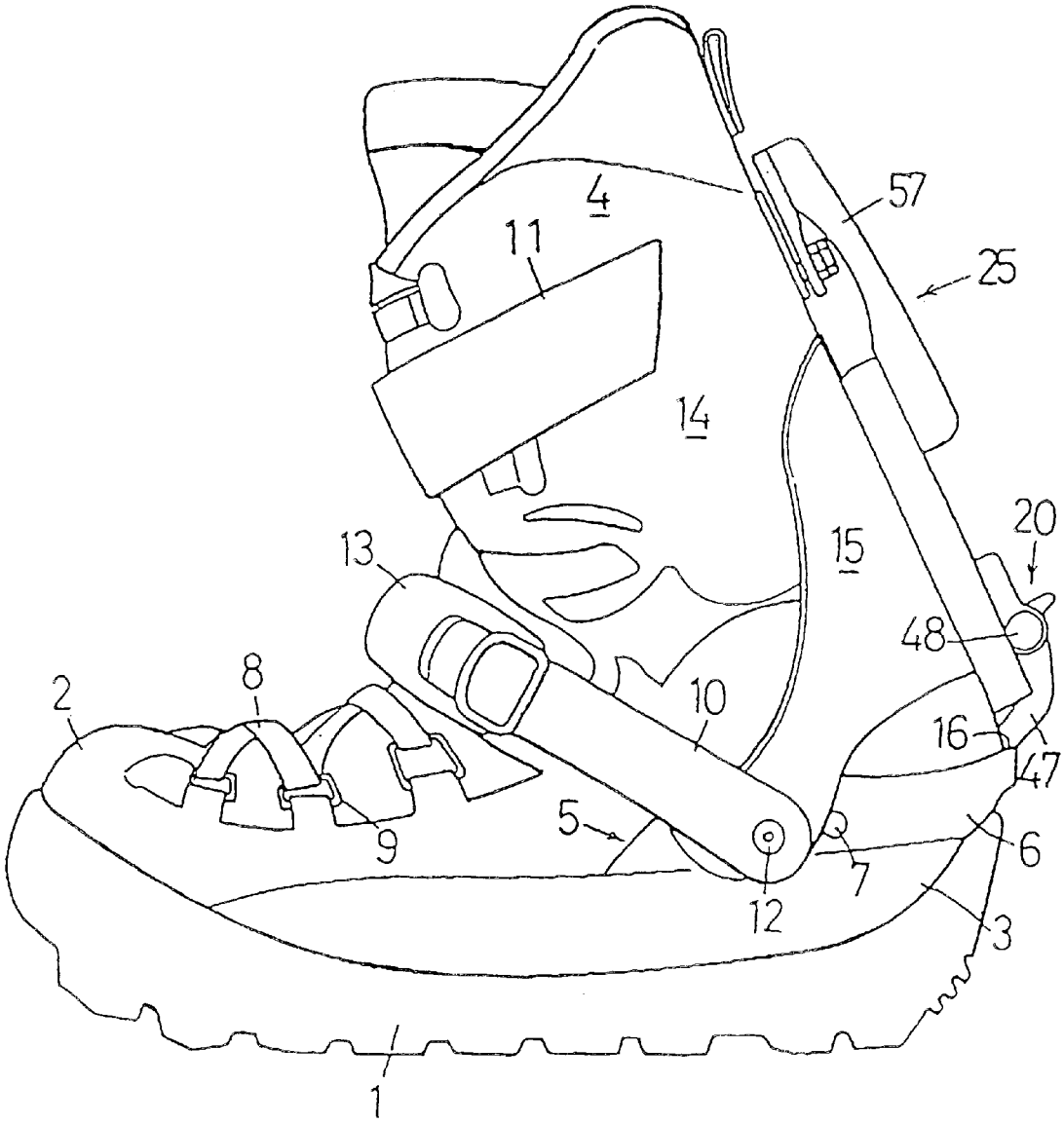
FIG. 1 is a side view of a particular embodiment of a snowboard boot according to the present invention.

FIG. 1 is a side view of a particular embodiment of a snowboard boot according to the present invention. In outline, the snowboard boot comprises a sole section 1, a toe section 2, a heel section 3 and a leg section 4. In the interior of the sole section 1, the toe section 2 and the heel section 3, a heel cup 5 formed as one-piece with a composite resin core is arranged on the bottom of the shoe. Such a heel cup is well known, do details of its construction shall be omitted.

Three high back support attachment holes 7 are formed on both sides of the upper portion 6 of the back section of the heel cup 5. The three high back attachment holes 7 are lined up in a straight horizontal line and are formed as drilled through holes. A strap 10 is pivotably coupled to one of the high back support attachment holes 7 on each side of the boot through shaft bolts 12. The strap 10 passes from one side of the boot to the other at the boundary of the leg section 4 and the toe section 2. When the leg section 4 is inclined forward, it bends at this boundary, so the positioning and clamping of the strap 10 at this boundary section facilitates the inclination of the boot.

A clamping device 13 is arranged on the strap 10 in order to adjust the length of the strap 10 and to clamp the strap 10 at a desired tightness. Because the structure and function of the clamping device 13 are well known, its discussion will be omitted. Another strap 11 is arranged on the leg section 4 in the same manner and, by means of the operation of the strap 11, the leg section 4 is fastened and fixed in a single unit with the ankle. A shoelace 8 passes through hooks 9 in a crossed manner to snugly fit the boot to the foot in the known manner.

The shaft bolts 12 on both sides of the snowboard boot also pivotably connect the high back support 15 to heel cup 5. The high back support 15 takes up the force from the ankle when the ankle is inclined rearward and transmits the rearward force to the heel cup 5. A stopper mechanism 20 is arranged at the lower center end of the high back support 15. As discussed in more detail below, the stopper mechanism 20 limits the rearward inclining action of the high back support 15.

Figure 2A:
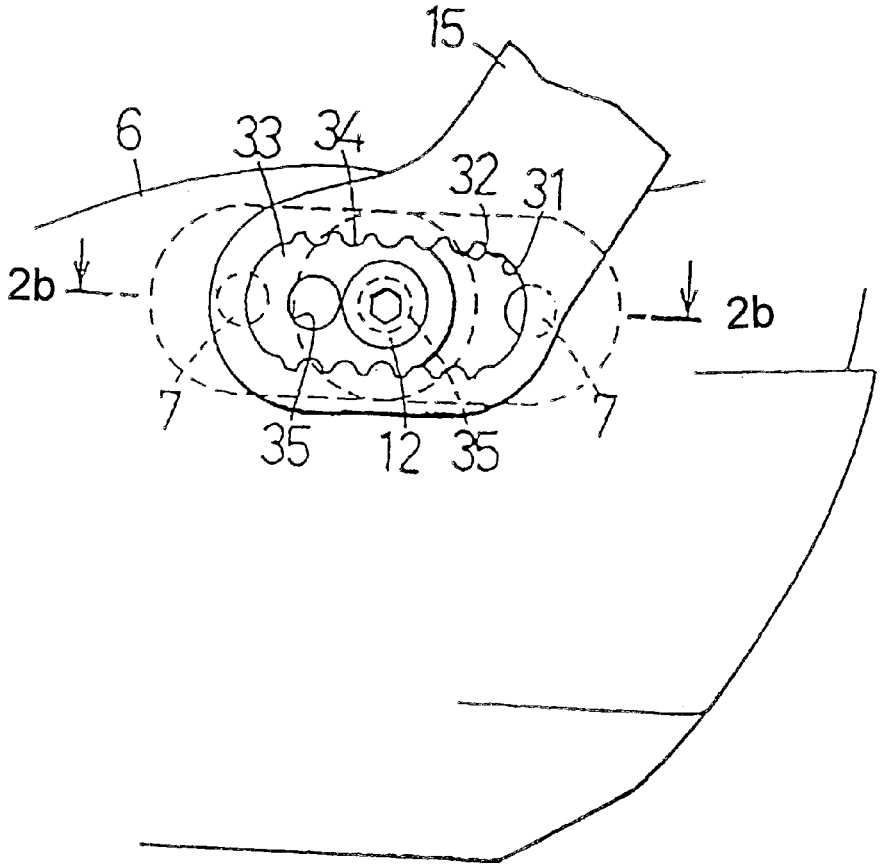
FIG. 2A is a detailed view of the coupling between the high back support and the heel cup shown in FIG. 1.
Figure 2B:
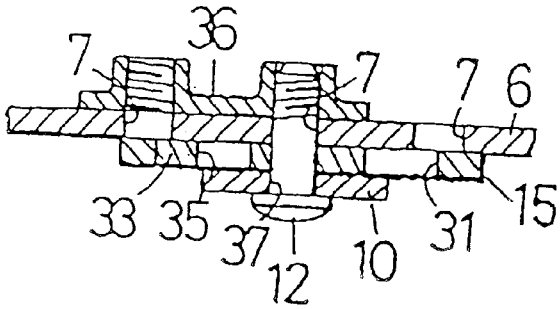
FIG. 2B is a view taken along line 2B—2B in FIG. 2A.

FIG. 2A is a detailed view of the coupling between the high back support 15 and the heel cup 5 shown in FIG. 1, and FIG. 2B is a view taken along line 2B—2B in FIG. 2A. As noted above, the three high back support attachment holes 7 are formed in a straight horizontal line. Oval shaped concave sections 31 are formed at a fixed depth at the periphery of the high back support attachment holes 7 so as to surround them. In the inner peripheral surface of the concave sections 31, wave shaped protuberances 32 are formed at a fixed pitch in an alternating concave-convex shape, and washers 33 are inserted inside the concave sections 31. On the outer perimeter surface of the washer 33, the wave shaped protuberances 34 are formed in an alternating concave-convex shape. Because the shapes of the wave shaped protuberances 32 and the wave shaped protuberances 34 match, the washer 33 can be matingly inserted into the concave section 31. Bolt holes 35 are formed in two locations in the washers 33. By means of varying the position of the washers 33 in the concave sections 31, it is possible to change the locations of the bolt holes 35.

To assemble the structure, the shaft bolt 12 is inserted into the attachment hole 37 of the strap 10 and then is inserted into the bolt hole 35 of the washer 33. Finally, the shaft bolt 12 is inserted through one of the three high back support attachment holes 7 and screwed into the nut 36 that has been arranged on the inner surface of the heel cup 5. As a result, the high back support 15 pivots around the shaft bolt 12 in the forward and rear directions, and it is possible to select six positions by means of the selection of one of the bolt holes 35 and one of the high back support attachment holes 7.

Figure 3:
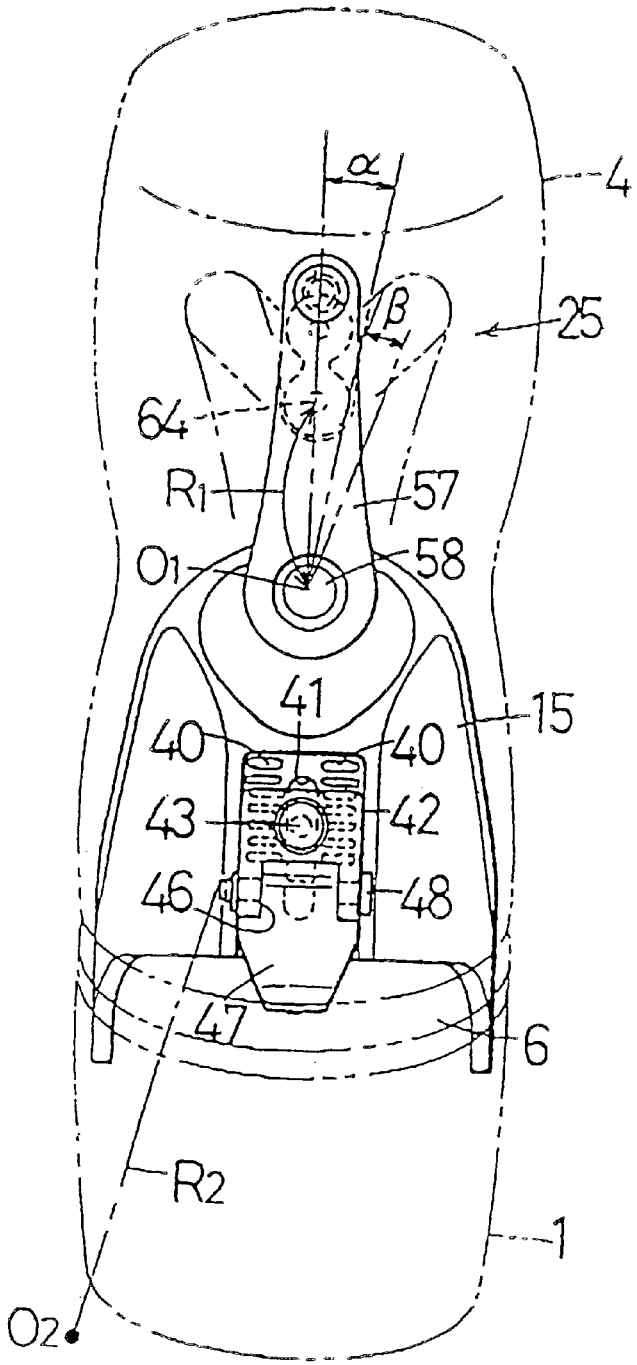
FIG. 3 is a rear view showing the high back support and linking mechanism shown in FIG. 1.
Figure 4:
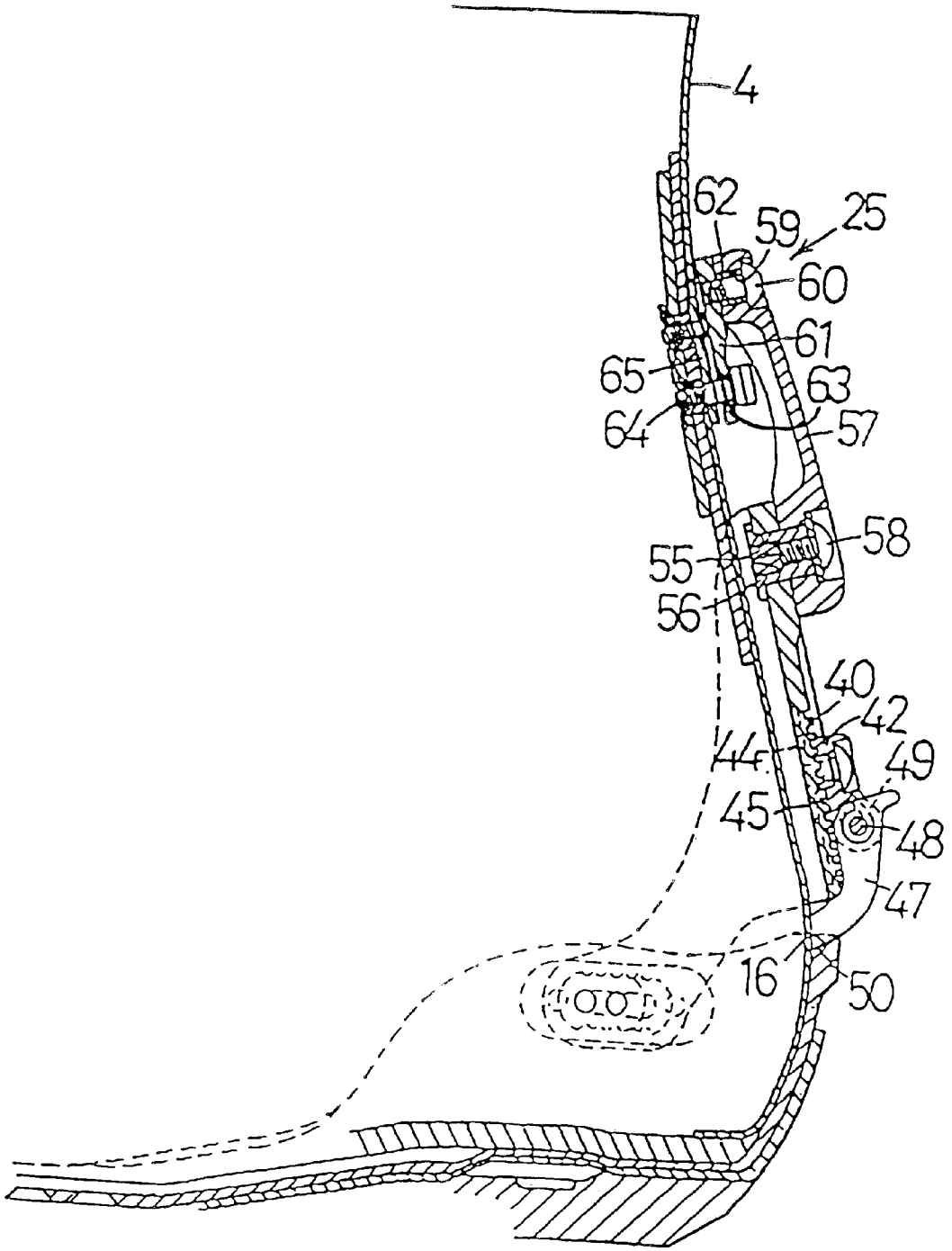
FIG. 4 is a cross sectional view of the high back support and linking mechanism shown in FIG. 3.

As is shown in FIGS. 3 and 4, rectangular position determination protuberances 40 are formed in two rows at a fixed pitch on the rear surface of the center portion of the high back support 15, and a bolt penetration hole 41 is formed between the position determination protuberances 40. A fixation plate 42 is fixed to the high back support 15 by means of a fixation bolt 43 and a nut 44. Rectangular position determination protuberances 45 are formed on the fixation plate 42 at a fixed pitch. Because the position determination protuberances 40 of the high back support 15 and the position determination protuberances 45 of the fixation plate 42 have an identical pitch, the fixation plate 42 can be matingly engaged and fixed at a desired location.

A concave shaped cut-out 46 is formed in the fixation plate 42, and a stopper lever 47 is pivotably mounted in the cut-out 46 by means of the shaft 48. The stopper lever 47 is biased against the high back support 15 side by a spring 49. A stopper surface 50 of the stopper lever 47 contacts the stopper surface 16 that is formed on the upper surface of the heel cup 5 to limit the rearward pivoting of the high back support 15 around the shaft bolt 12.

A linking mechanism 25 is arranged at the upper edge of the high back support 15. The linking mechanism 25 helps to transmit the rearward inclining action of leg section 4 to high back support 15 which, in turn, transmits the rearward inclining action to heel cup 5. The linking mechanism 25 also accommodates the compound forward and sideways inclination of the ankle.

Figure 5:
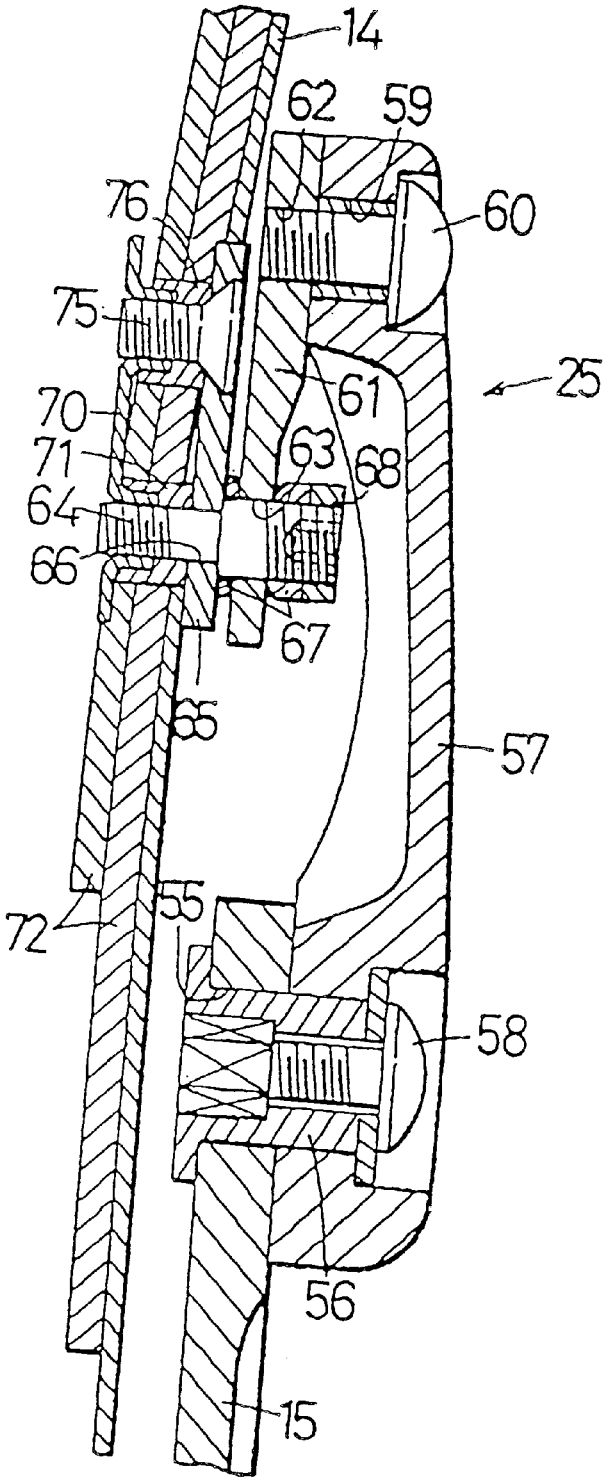
FIG. 5 is a detailed view of the linking mechanism shown in FIG. 4.

FIG. 4 is a cross sectional view of the high back support 15 and linking mechanism 25 shown in FIG. 3, and FIG. 5 is a detailed view of the linking mechanism 25. As shown in those Figures, a penetrating hole 55 is formed at the upper edge of the high back support 15, and a nut 56 having a flange is inserted into the penetrating hole 55. A first shaft bolt 58 is screwed into the flanged nut 56, and one end of the first link 57 is pivotably coupled to the first shaft bolt 58. Another penetrating hole 59 is formed at the other end of the first link 57, and a bushing is inserted into the penetrating hole 59. A second shaft bolt 60 is inserted into this bushing, and the tip of this second shaft bolt 60 is screwed into a screw hole 62 that is formed at one end of the second link 61. A penetrating hole 63 is formed in the other end of the second link 61, and a bushing (not shown in the figure) is inserted into the penetrating hole 63. A third shaft bolt 64 is inserted into this bushing and is inserted into a penetrating hole 66 that is formed on one end of the fixation plate 65. Two spherical washers 67 are inserted onto the third shaft bolt 64 and are arranged so that the second link 61 is held between the two spherical washers. The spherical washers 67 are locked to the third shaft bolt 64 by means of a locknut 68. Because the second link 61 is held between the spherical washers 67, a pivoting movement of second link 61 and a slight spherical movement are possible around the third shaft bolt 64.

A bushing 71 is arranged on the periphery of the third shaft bolt 64, and the third shaft bolt 64 is screwed into the nut plate 70. The back support 72, which is made of a stiff composite resin, is held between the nut plate 70 and the fixation plate 65. In the same manner, a fixation bolt 75 is arranged at the other end of the fixation plate 65, a bushing 76 is arranged on the periphery of the fixation bolt 75, and fixation bolt 75 is screwed into the nut plate 70. Thus, the fixation plate 65 and the third shaft bolt 64 are fixed to the back support 72.

In summary, one end of the second link 61 is pivotably supported on the fixed third shaft bolt 64, one end of the first link 57 is pivotably supported on the second shaft bolt 60 fixed to the other end of the second link 61, and the other end of first link 57 is pivotably supported on the first shaft bolt 58 fixed to the high back support 15. These mechanisms, in essence, comprise the two-link, three-joint linking mechanism 25.

When one puts on the snowboard boots having the structure just described and rides on the snowboard (not shown in the figures), the legs are moved in order to control the speed and direction of the snowboard. When the leg is inclined in the forward direction, the forward inclination is pivoted in the vicinity of the ankle bone due to the structure of the human foot. As a result, the leg section 4 of the snowboard boot inclines forward. This forward inclination is possible because the leg section 4 is flexible and can pivot around shafts 12.

Similarly, when the leg is inclined backward, the backward inclination is pivoted in the vicinity of the ankle bone due to the structure of the human foot. As a result, the leg section 4 of the snowboard boot inclines backward. This backward inclining action of the foot section 4 is transmitted to the high back support 15 through the linking mechanism 25. When the stopper surface 50 of the stopper lever 47 comes into contact with the stopper surface 16 that is formed on the upper surface of the heel cup 5, the pivoting movement of the high back support 15 is stopped. Thereafter, the backward inclining action of the leg is transmitted to the heel cup 5, this force is transmitted to the snowboard (not shown in the figures), and smooth running control is carried out.

The case in which the leg inclines sideways will be discussed while referring to FIG. 3. When the forward direction is in the direction from the heel toward the toes, if the leg is inclined sideways, the center of the third shaft bolt 64 initially swings an angle $\alpha$ around the center O1 of the first shaft bolt 58 at a radius R1, with the first shaft bolt 58 acting as a pivot. The movement of this angle $\alpha$ approximates a swinging movement of the leg with the ankle bone as the pivot. When the angle of movement a is completed, second link 61 pivots around third shaft bolt 64 as first link 57 continues to pivot around first shaft bolt 58 until first link 57 pivots through an angle $\beta$. The combined pivoting around third shaft bolt 64 and first shaft bolt 58 produces an overall pivoting at a radius R2 centered around a center O2 located near the inside of the sole 1. This, in turn, approximates a change from a pivoting with the ankle bone as the pivot center to a pivoting with the heel as the pivot center. Thus, as can be understood from the above description, because linking mechanism 25 is equipped with two links and three joints, it can accommodate complex movement of the swinging of the leg section 4 of the snowboard boot.

Figure 6:
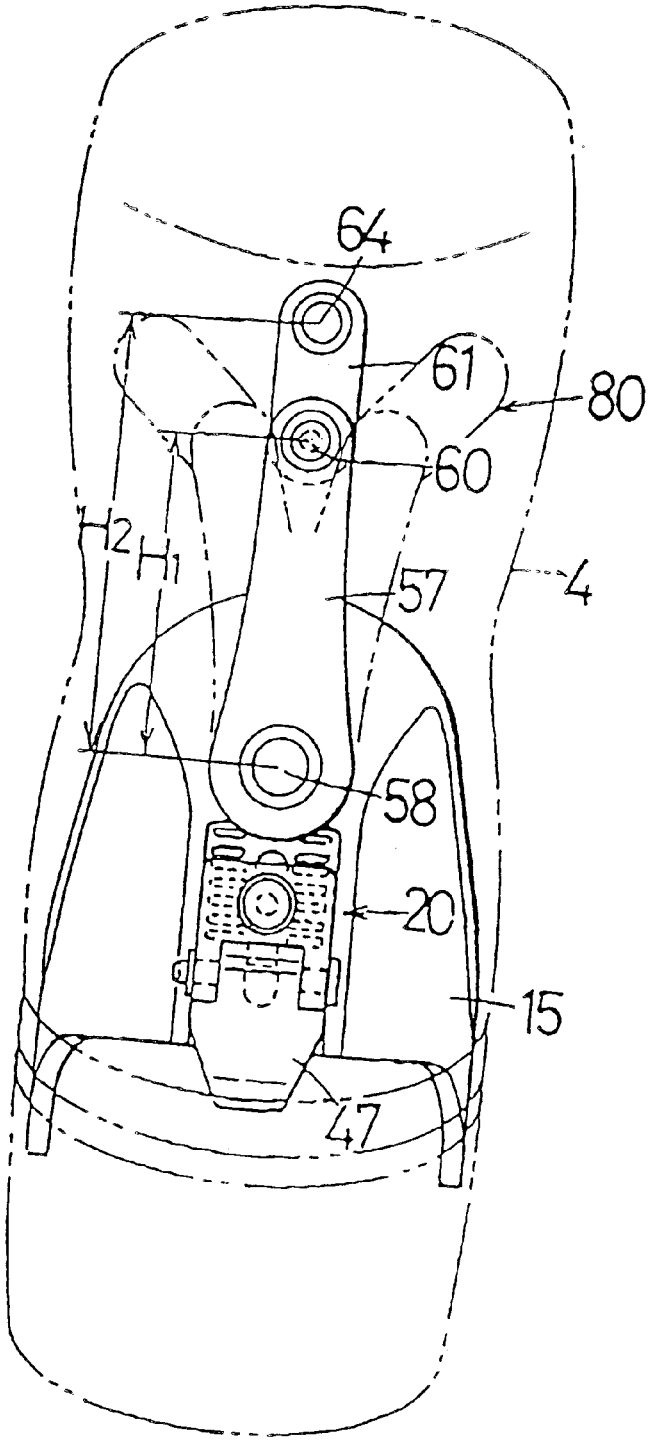
FIG. 6 is a rear view of an alternative embodiment of the high back support and linking mechanism according to the present invention.
Figure 7:
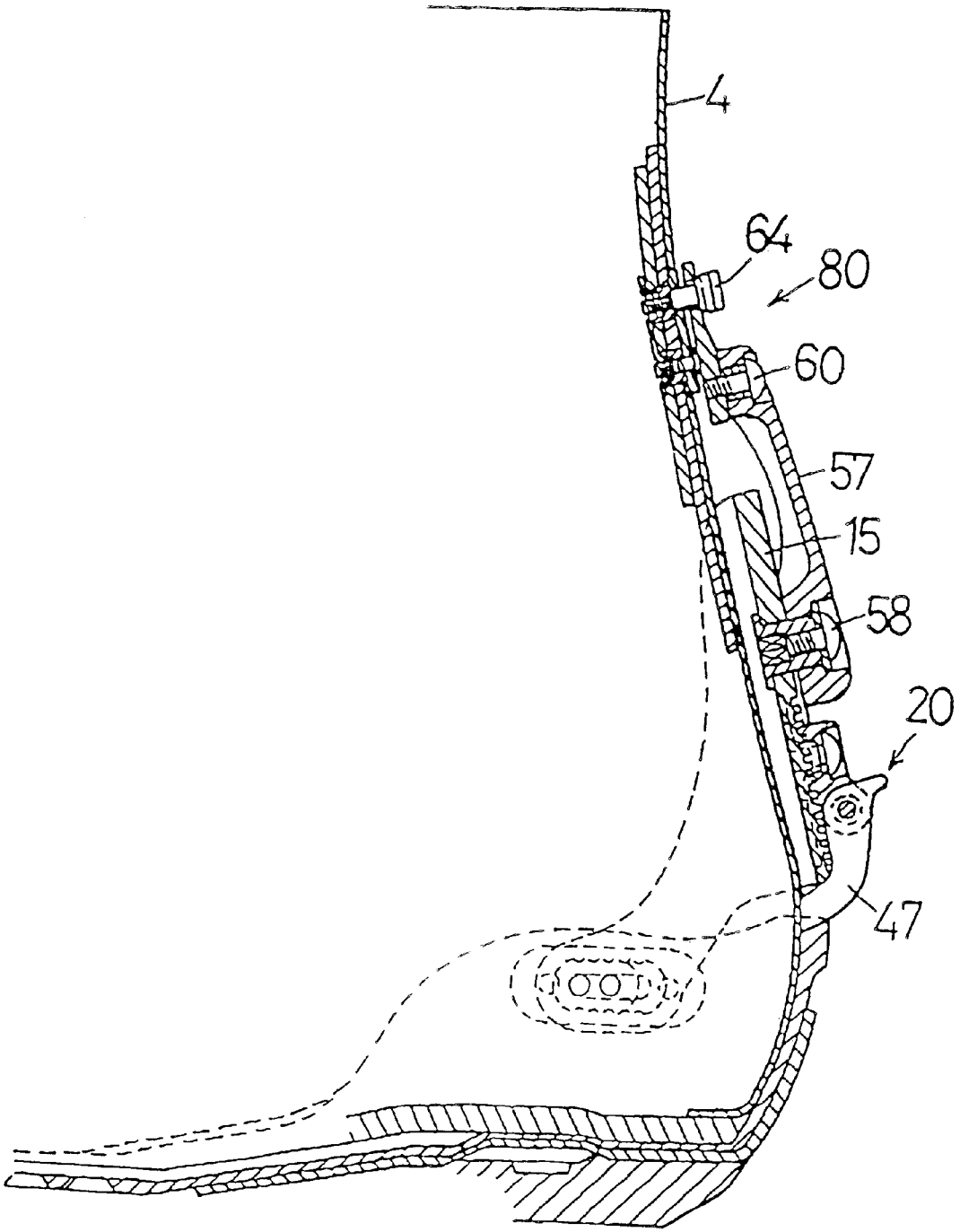
FIG. 7 is a cross sectional view of the high back support and linking mechanism shown in FIG. 6.

The link mechanism 25 described above was arranged with the first shaft bolt 58 in the lowest position and the second shaft bolt 60 positioned higher than that of the third shaft bolt 64. However, this positioning is not necessary. For example, the linking mechanism 80 that is shown in FIGS. 6 and 7, from the standpoint of being a two-link, three-joint linking mechanism, is identical to the linking mechanism 25 of the first embodiment described above, and the length of the two links are identical. However, linking mechanism 80 differs from linking mechanism 25 in that the position of the third shaft bolt 60 is different. In other words, if the position of the first shaft bolt 58 is made the reference, the second shaft bolt 60 is positioned at a position with a height of H1 and the third shaft bolt 64, which is fixed to the leg section 4 of the snowboard boot, is positioned at a position with a height of H2, where H2>H1 In this case the motion of first link 57 and second link 61 is shown by the broken lines. The motion of third shaft bolt 64 is similar to an arc centered around first shaft bolt 58 at a radius H2.

Figure 8:
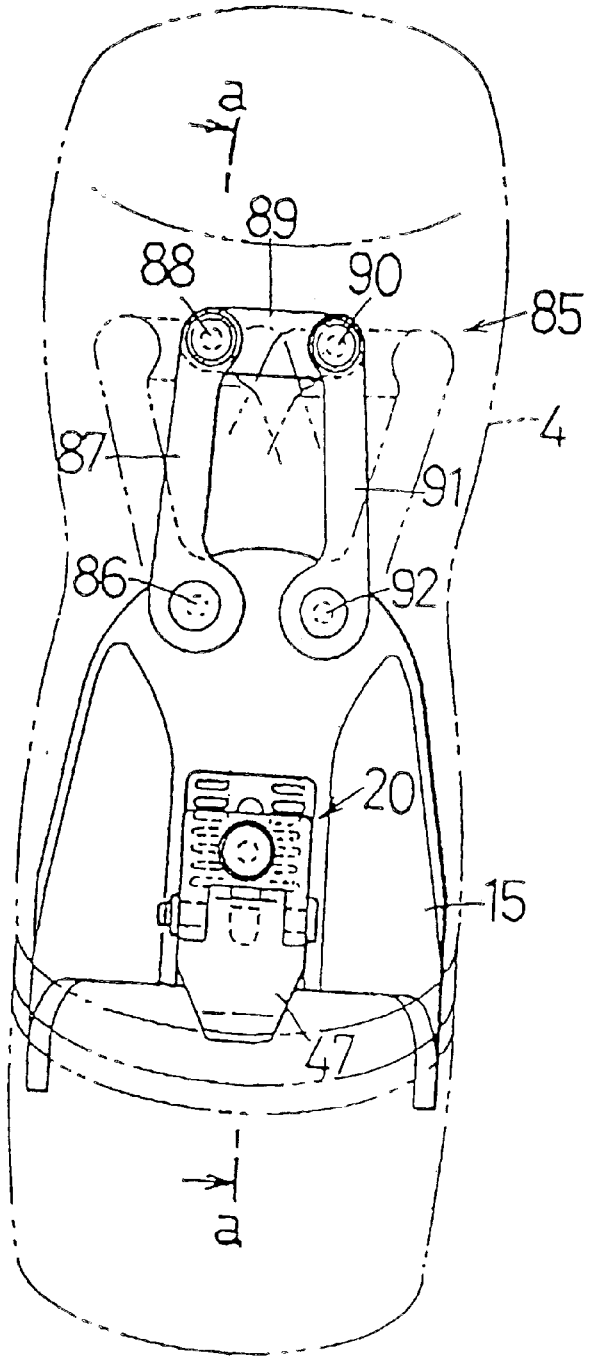
FIG. 8 is a rear view of another alternative embodiment of the high back support and linking mechanism according to the present invention.
Figure 9:
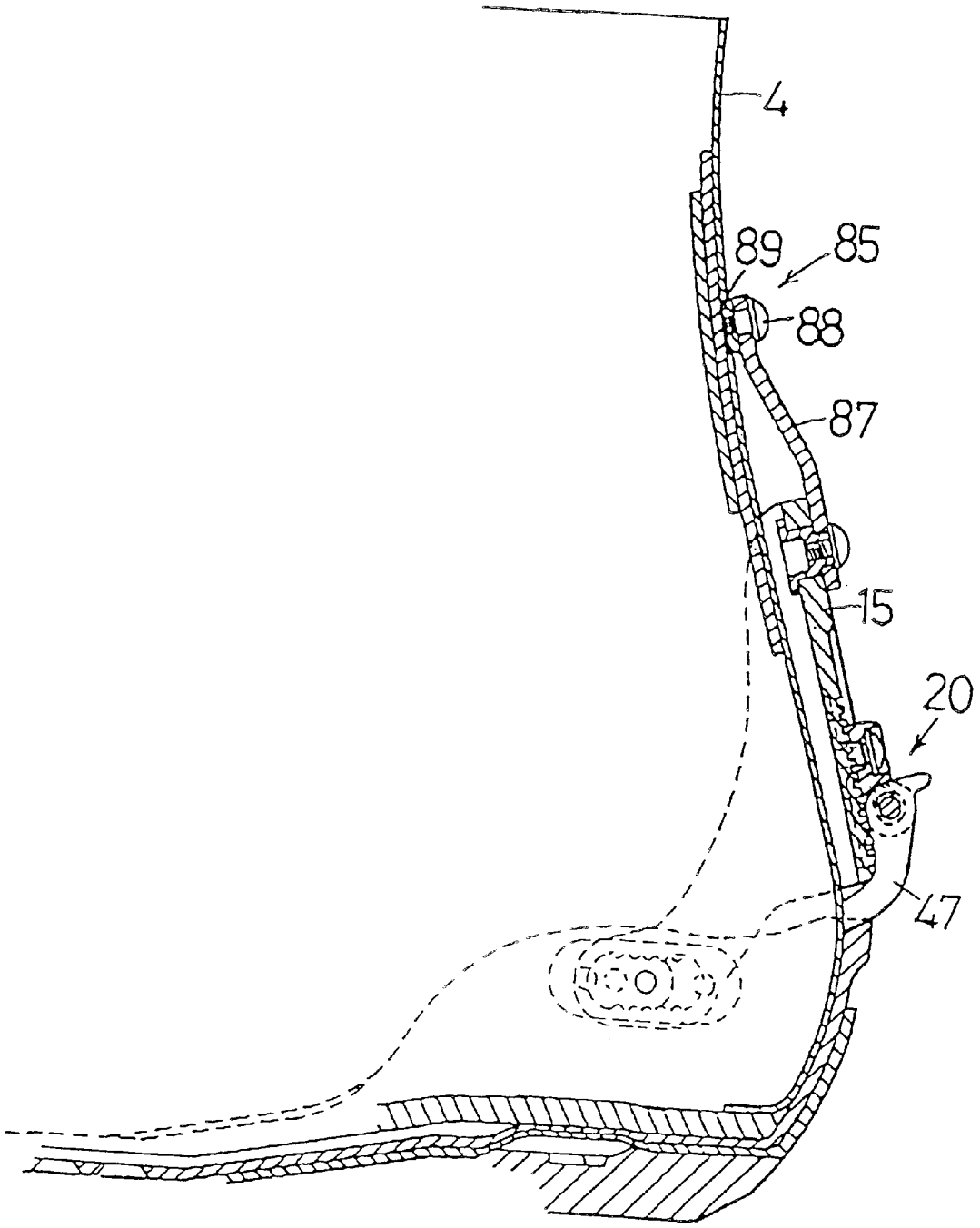
FIG. 9 is a cross sectional view of the high back support and linking mechanism shown in FIG. 8.

The first and second embodiments described above illustrated two-link three-joint link mechanisms 25 and 80. FIGS. 8 and 9 show a four-link parallel linking mechanism 85. A four-link parallel linking mechanism 85 does not move in an arc about a portion of the leg section 4 but is a mechanism that is used when the leg section 4 is desired to move horizontally as a whole. In this embodiment, the lower end of a first link 87 is pivotably coupled to the high back support 15 by a first shaft bolt 86, and the lower end of a third link 91 is pivotably coupled to the high back support by a fourth shaft bolt 92. The upper end of the first link 87 is pivotably coupled to one end of a second link 89 by a second shaft bolt 88, and the second shaft bolt 88 is fixed to the leg section 4. The other end of the second link 89 is pivotably coupled to the upper end of the third link 91 by a third shaft bolt 90, and the third shaft bolt 90 is fixed to the leg section 4. As a result, a four-link parallel linking mechanism 85 is configured by the high back support 15, the first shaft bolt 86, the first link 87, the second shaft bolt 88, the second link 89, the third shaft bolt 90, the third link 91 and the fourth shaft bolt 92. Because the second shaft bolt 88 and the third shaft bolt 90 are fixed to the leg section 4 of the snowboard boot, the leg section 4 accommodates the sideways movement of the leg with a parallel movement. In other words, the movement is parallel to the planar direction of the sole.

Figure 10:
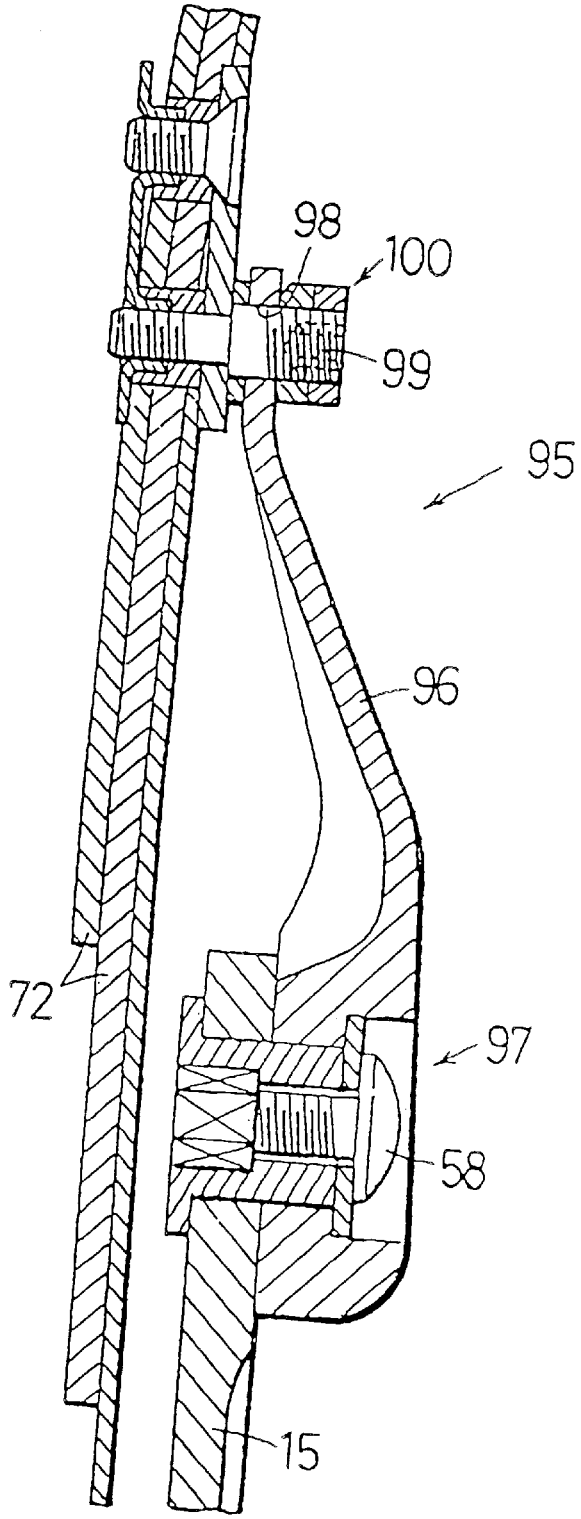
FIG. 10 is a cross sectional view of another alternative embodiment of the high back support and linking mechanism according to the present invention.

FIG. 10 is a cross-sectional view of a linking mechanism 95 according to a fourth embodiment of the present invention. The linking mechanism 95 in this embodiment is a one-link, two-joint mechanism. With this linking mechanism 95, if the back support 72 is viewed as a rigid body, it is a fixed chained mechanism. However, because the actual back support 72 has, as previously mentioned, some flexibility, it is not a fixed chained mechanism.

As shown in FIG. 10, one end of a first link 96 is pivotably coupled to first shaft bolt 58 to form a first joint 97, and the other end of first link 96 is pivotably coupled to a second shaft bolt 99 that extends through a penetrating hole 98 to form a second joint 100. While not as precise as the first and second embodiments described above, it is a simple mechanism that provides satisfactory control in some situations.

Figure 11:
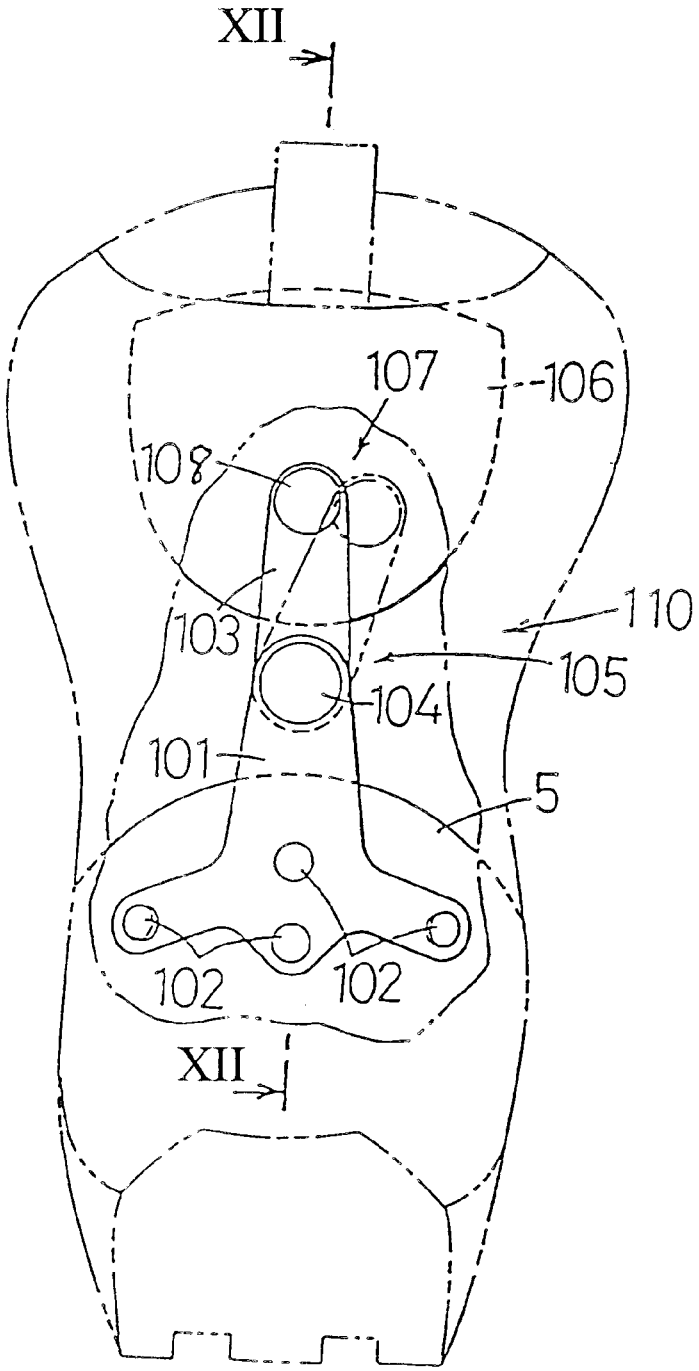
FIG. 11 is a rear view of another alternative embodiment of the high back support and linking mechanism according to the present invention.
Figure 12:
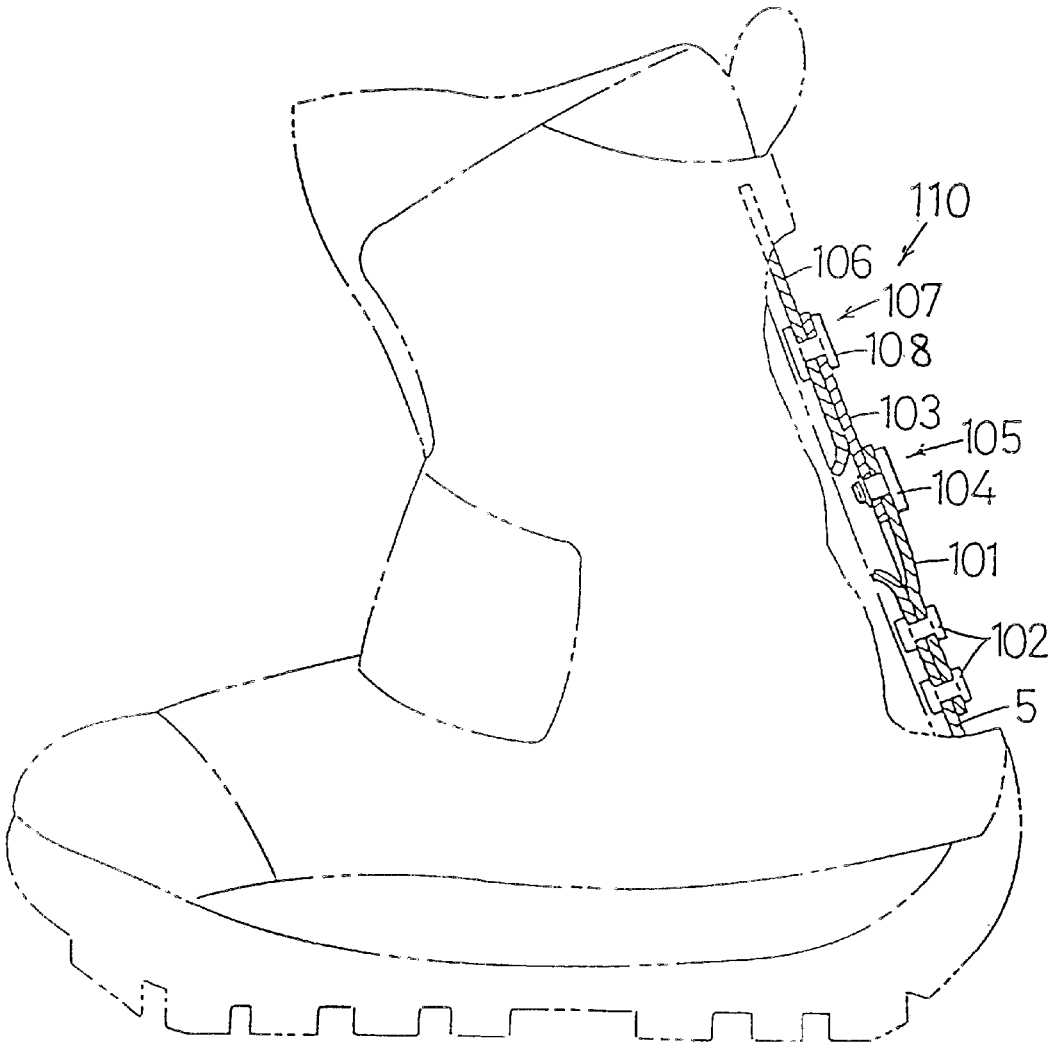
FIG. 12 is a view taken along line XII—XII in FIG. 11.

FIG. 11 is a rear view, and FIG. 12 is a cross-sectional view, of a fifth embodiment of a high back support and linking mechanism 110 according to the present invention. The bottom portion of a first joint support fitting 101 constructed from a Y-shaped metal plate is attached by rivets 102 to the back surface of the rear section of a heel cup 5. The lower end of a first link 103 is pivotally coupled by a shaft 104 to the upper end of the first joint support fitting 101. The shaft 104 is a component of a first joint 105.

The upper end of the first link 103 is rotatably supported by a shaft 108 on a leg-section back support 106. The shaft 108 is a component of a second joint 107. The link mechanism 110 is ultimately composed of a one-link, two-joint link mechanism similar to the link mechanism 95 described above. The height of the first joint 105 can be set at an arbitrary level, and the range within which the position of the first joint 105 can be adjusted is widened because the link mechanism 110 is constructed using the first joint support fitting 101. Another advantage of the link mechanism 110 is that, similar to the heel cup 5, the link mechanism 110 can be disposed on a low back support.

While the above is a description of various embodiments of the present invention, further modifications may be employed without departing from the spirit and scope of the present invention. For example, the size, shape, location or orientation of the various components may be changed as desired. The functions of one element may be performed by two, and vice versa. Thus, the scope of the invention should not be limited by the specific structures disclosed. Instead, the true scope of the invention should be determined by the following claims.

What is claimed is:

1. A back support apparatus for a snowboard boot comprising:

a back support member for supporting a back surface of an ankle;

a linking mechanism coupled to the back support member for coupling the back support member to a leg member of the snowboard boot;

wherein the linking mechanism includes a first pivot coupling and a second pivot coupling; and wherein the first pivot coupling and the second pivot coupling are located so that a center of pivoting of the linking mechanism changes upon sideways inclination of the leg member.

2. The apparatus according to claim 1 wherein the first pivot coupling pivots around a first axis extending from back to front.

3. The apparatus according to claim 1 wherein the linking mechanism comprises a first link having a first section pivotably coupled to the back support member at the first pivot coupling and a second section containing the second pivot coupling.

4. The apparatus according to claim 3 further comprising the leg member disposed above the back support member, wherein the second section of the first link is pivotably coupled to the leg member at the second pivot coupling.

5. The apparatus according to claim 4 wherein the first pivot coupling pivots around a first axis extending from back to front.

6. The apparatus according to claim 5 wherein the second pivot coupling pivots around a second axis extending from back to front.

7. A back support apparatus for a snowboard boot comprising:

a back support member for supporting a back surface of an ankle;

a linking mechanism coupled to the back support member for coupling the back support member to a leg member of the snowboard boot;

wherein the linking mechanism includes a first pivot coupling and a second pivot coupling;

wherein the first pivot coupling pivots around a first axis extending from back to front; and wherein the second pivot coupling pivots around a second axis extending from back to front.

8. A back support apparatus for a snowboard boot comprising:

a back support member for supporting a back surface of an ankle;

a linking mechanism coupled to the back support member for coupling the back support member to a leg member of the snowboard boot;

wherein the linking mechanism includes a first pivot coupling and a second pivot coupling;

wherein the linking mechanism comprises:

a first link having a first section pivotably coupled to the back support member at the first pivot coupling and a second section containing the second pivot coupling; and a second link having a first section pivotably coupled to the second section of the first link at the second pivot coupling.

9. The apparatus according to claim 8 further comprising the leg member disposed above the back support member, wherein a second section of the second link is pivotably coupled to the leg member at a third pivot coupling.

10. The apparatus according to claim 9 wherein the first pivot coupling pivots around a first axis extending from back to front.

11. The apparatus according to claim 10 wherein the second pivot coupling pivots around a second axis extending from back to front.

12. The apparatus according to claim 11 wherein the third pivot coupling pivots around a third axis extending from back to front.

13. The apparatus according to claim 9 wherein the second pivot coupling is disposed above the third pivot coupling.

14. The apparatus according to claim 9 wherein the second pivot coupling is disposed below the third pivot coupling.

15. The apparatus according to claim further comprising a third link having a first section pivotably coupled to the second section of the second link at the third pivot coupling and a second section pivotably coupled to the back support member at a fourth pivot coupling.

16. The apparatus according to claim 15 wherein the first pivot coupling pivots around a first axis extending from back to front, wherein the second pivot coupling pivots around a second axis extending from back to front, wherein the third pivot coupling pivots around a third axis extending from back to front, and wherein the fourth pivot coupling pivots around a fourth axis that extends from rear to front.

17. The apparatus according to claim 15 further comprising the leg member disposed above the back support member, wherein the second link is fixedly secured relative to the leg member.

18. The apparatus according to claim 8 further comprising a heel cup pivotably coupled to the back support member for supporting a back surface of a heel, wherein the heel cup is disposed below the back support member.

19. The apparatus according to claim 18 wherein the back support member is pivotably coupled to a side of the heel cup so that the back support member pivots in a forward and backward direction relative to the heel cup.

20. The apparatus according to claim 19 further comprising a stopper mechanism for limiting pivoting of the back support member in the backward direction.

21. A snowboard boot comprising:

a sole section;

a toe section disposed in the front of the boot;

a heel section disposed in the rear of the boot;

a leg section extending upwardly from the sole section;

a heel cup disposed in the heel section for supporting a back surface of a heel;

a back support member disposed above the heel cup for supporting a back surface of an ankle;

a linking mechanism coupled between the back support member and the leg section; and wherein the linking mechanism includes a first pivot coupling and a second pivot coupling; and wherein the first pivot coupling and the second pivot coupling are located so that a center of pivoting of the linking mechanism changes upon sideways inclination of the leg member.

22. The snowboard boot according to claim 21 wherein the first pivot coupling pivots around a first axis extending from back to front.

23. The snowboard boot according to claim 21 wherein the linking mechanism comprises a first link having a first section pivotably coupled to the back support member at the first pivot coupling and a second section containing the second pivot coupling.

24. The snowboard boot according to claim 23 wherein the second section of the first link is pivotably coupled to the leg section at the second pivot coupling.

25. The snowboard boot according to claim 24 wherein the first pivot coupling pivots around a first axis extending from back to front.

26. The snowboard according to claim 25 wherein the second pivot coupling pivots around a second axis extending from back to front.

27. A snowboard boot comprising:

a sole section;

a toe section disposed in the front of the boot;

a heel section disposed in the rear of the boot;

a leg section extending upwardly from the sole section;

a heel cup disposed in the heel section for supporting a back surface of a heel;

a back support member disposed above the heel cup for supporting a back surface of an ankle;

a linking mechanism coupled between the back support member and the leg section;

wherein the linking mechanism includes a first pivot coupling and a second pivot coupling;

wherein the first pivot coupling pivots around a first axis extending from back to front; and wherein the second pivot coupling pivots around a second axis extending from back to front.

28. A snowboard boot comprising:

a sole section;

a toe section disposed in the front of the boot;

a heel section disposed in the rear of the boot;

a leg section extending upwardly from the sole section;

a heel cup disposed in the heel section for supporting a back surface of a heel;

a back support member disposed above the heel cup for supporting a back surface of an ankle;

a linking mechanism coupled between the back support member and the leg section;

wherein the linking mechanism includes a first pivot coupling and a second pivot coupling;

wherein the linking mechanism comprises:

a first link having a first section pivotably coupled to the back support member at the first pivot coupling and a second section containing the second pivot coupling; and a second link having a first section pivotably coupled to the second section of the first link at the second pivot coupling.

29. The snowboard boot according to claim 28 wherein a second section of the second link is pivotably coupled to the leg section at a third pivot coupling.

30. The snowboard boot according to claim 29 wherein the first pivot coupling pivots around a first axis extending from back to front.

31. The snowboard boot according to claim 30 wherein the second pivot coupling pivots around a second axis extending from back to front.

32. The snowboard boot according to claim 31 wherein the third pivot coupling pivots around a third axis extending from back to front.

33. The snowboard boot according to claim 29 wherein the second pivot coupling is disposed above the third pivot coupling.

34. The snowboard boot according to claim 29 wherein the second pivot coupling is disposed below the third pivot coupling.

35. The snowboard boot according to claim 29 further comprising a third link having a first section pivotably coupled to the second section of the second link at the third pivot coupling and a second section pivotably coupled to the back support member at a fourth pivot coupling.

36. The snowboard boot according to claim 35 wherein the first pivot coupling pivots around a first axis extending from back to front, wherein the second pivot coupling pivots around a second axis extending from back to front, wherein the third pivot coupling pivots around a third axis extending from back to front, and wherein the fourth pivot coupling pivots around a fourth axis that extends from rear to front.

37. The snowboard boot according to claim 36 wherein the second link is fixedly secured relative to the leg section.

38. The snowboard boot according to claim 28 wherein the back support member is pivotably coupled to a side of the heel cup so that the back support member pivots in a forward and backward direction relative to the heel cup.

39. The snowboard boot according to claim 38 further comprising a stopper mechanism for limiting pivoting of the back support member in the backward direction.

* * * * *